United States Patent [19]

Kailus

[11] Patent Number: 4,629,269

[45] Date of Patent: Dec. 16, 1986

[54] ELECTRICAL CONNECTOR WITH ENVIRONMENTAL SEAL

[75] Inventor: William A. Kailus, North Riverside, Ill.

[73] Assignee: Allied Corporation, Morris Township, Morris County, N.J.

[21] Appl. No.: 275,411

[22] Filed: Jun. 19, 1981

Related U.S. Application Data

[63] Continuation of Ser. No. 82,491, Feb. 21, 1979, abandoned, which is a continuation of Ser. No. 845,187, Oct. 25, 1977, abandoned.

[51] Int. Cl.[4] ..... H01R 13/52

[52] U.S. Cl. ..... 339/59 M

[58] Field of Search ..... 339/59 R, 59 M, 60 R, 339/60 M, 94 R, 94 M; 174/153 G, 77 R, 65 G, 65 SS

[56] References Cited

U.S. PATENT DOCUMENTS

| | | | |
|---|---|---|---|
| 2,619,515 | 11/1952 | Doane | 339/94 |
| 2,620,029 | 12/1952 | Turechek et al. | 175/4.56 |
| 2,700,141 | 1/1955 | Jones | 339/96 |
| 2,820,088 | 1/1958 | Sperry | 174/153 G |
| 3,456,231 | 7/1969 | Paullus et al. | 339/60 M |
| 3,456,232 | 7/1969 | Dupre | 339/96 |
| 3,512,119 | 5/1970 | Cameron | 339/90 |
| 3,522,576 | 8/1970 | Cairns | 339/91 |
| 3,727,172 | 4/1973 | Clark | 339/59 M |
| 3,784,959 | 1/1974 | Horton | 339/60 M |
| 3,792,416 | 2/1974 | Moulin | 339/94 R |
| 3,941,444 | 3/1976 | Bruni et al. | 339/60 M |
| 3,970,352 | 7/1976 | Dorrell et al. | 339/59 M |

FOREIGN PATENT DOCUMENTS

| | | | |
|---|---|---|---|
| 1202435 | 7/1959 | France . | |
| 1255427 | 1/1961 | France . | |
| 1342949 | 10/1963 | France | 174/153 G |
| 1493690 | 7/1967 | France . | |
| 2130123 | 11/1972 | France . | |
| 2314595 | 1/1977 | France . | |
| 257046 | 4/1964 | Netherlands . | |
| 823722 | 11/1959 | United Kingdom | 174/153 G |
| 988663 | 4/1965 | United Kingdom . | |
| 1061399 | 3/1967 | United Kingdom . | |

*Primary Examiner*—Neil Abrams

*Attorney, Agent, or Firm*—Roger H. Criss

[57] ABSTRACT

An electrical connector is disclosed having a unique means for sealing the conductor-receiving end of an electrical connector. The seal is effected by molding a membrane as an integral part of the elastomeric insert or grommet used at the rear of the connector, the membrane having a thickness sufficient to maintain the integrity of the seal over any vacant insert pockets but insufficient to prevent or impair normal and proper insertion of a contact terminated conductor into the connector.

3 Claims, 4 Drawing Figures

ELECTRICAL CONNECTOR WITH ENVIRONMENTAL SEAL

This is a continuation of application Ser. No. 082,491, now abandoned, filed Feb. 21, 1979 which in turn was a continuation of Ser. No. 845,187, filed Oct. 25, 1977 now abandoned.

BACKGROUND OF THE INVENTION

The present invention is directed to electrical connectors and, more particularly, to an electrical connector having improved means for sealing the connector from moisture and other harmful substances.

For several years demand has been increasing in the transportation, communication and data processing industries for electrical connectors capable of withstanding severe environmental conditions retaining or even improving their serviceability. A need for such connectors is particularly acute in the aerospace industry where reliability in extreme environments and serviceability are most important. In response to this demand, a variety of connectors have been developed having means to effectively seal the contacts within the connector shell while still enabling removal and reinstallation of an individual contact should maintenance of the connector so require. One approach to this problem has been to seal the rearward or conductor-receiving end of the connector components with an elastomeric insert or grommet, the individual contacts being forced through restrictive apertures in the grommet during installation or removal. Typical examples of such connectors are illustrated in U.S. Pat. Nos. 3,336,569; 3,512,119; 3,786,396; and 3,960,428. While these connectors provide adequate sealing in those applications where contacts are utilized in all of the connector's contact pockets, they do not properly seal the interior of the connector when all the available contact pockets are not in use. Moisure, for example, may enter and permeate the interior of the connector through any of the unused pockets.

To overcome this problem prior art connectors have been provided with miniature plugs which are inserted into the unused pockets. This approach, however, is costly, both in terms of manufacture and assembly, and is dependent upon the reliability of the assemblor who must insure that a plug is inserted within every empty pocket. Moreover, since the plug is a separate component, if it is not properly installed the seal may be ineffective which, in turn, may give rise to field failure of the connector.

Another suggested approach for resolution of this problem has been the application of a coating to the rearward exterior of the grommet. The coating may be applied either before or after the connector has been assembled to the contact terminated conductors, but conventional practice is to apply the coating prior to assembly. This technique, however, is both time consuming and labor intensive, making it costly and unappealing to the connector user. Once again, the integrity of the seal is dependent upon the proper application of the coating and, as a result, the field reliability of the connector is not ideal.

SUMMARY OF THE INVENTION

Accordingly, the present invention is directed to an electrical connector having a unique means of sealing the rearward end of the connector which overcomes the problems and disadvantages attendant to the use of prior art connectors. The sealing mechanism of the present invention is very inexpensive and reliable, eliminates the use of separate sealing components and does not require any additional assembly operations by the connector user.

In its broadest aspect, the invention is directed to an electrical connector wherein the elastomeric insert or grommet includes an integrally molded membrane at its rearward end which completely seals each conductor-receiving pocket. The membrane has a thickness sufficient to assure and maintain the integrity of the seal during normal operation of the connector with the pocket empty or vacant. Yet the membrane is not so thick as to prevent or impede the normal and proper insertion of the contact terminated conductor into the connector.

BRIEF DESCRIPTION OF THE DRAWINGS

The features of the present invetion which are believed to be novel are set forth with particularity in the appended claims. The invention itself, however, together with further objects and attendant advantages thereof, may best be understood by reference to the following description taken in connection with the accompanying drawings, in which:

DETAILED DESCRIPTION OF THE PREFERRED EMBODIMENTS

Figure 1:
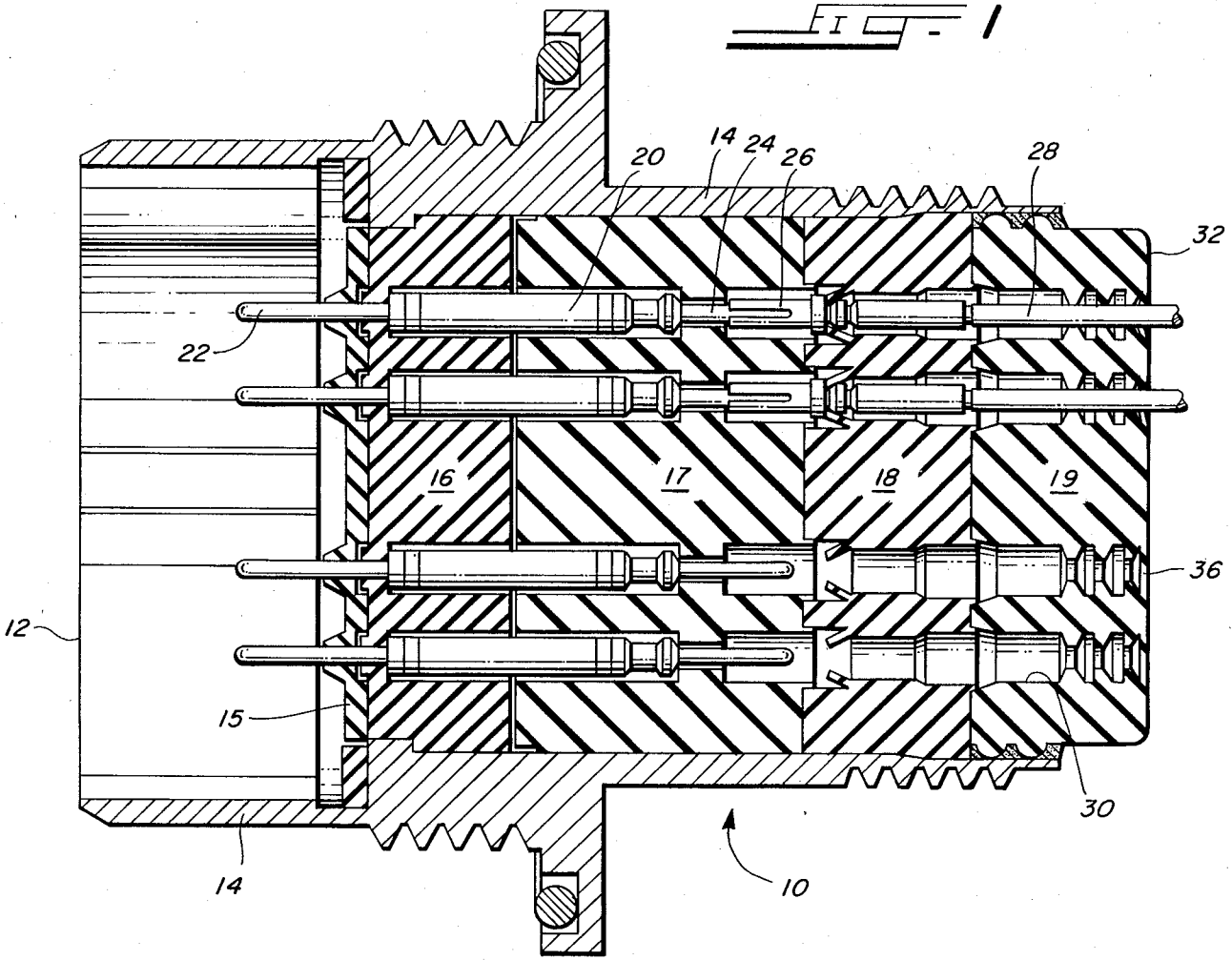
FIG. 1 is a cross-sectional view of an electrical connector embodying the unique sealing means of the present invention and showing both vacant insert pockets and pockets receiving and supporting contact terminated conductors.

A multi-contact environmentally sealed electrical connector component is illustrated in FIG. 1 and is designated generally by reference number 10. The connector component 10 is adapted for mounting to a supporting surface or bulkhead and includes a forward mating end 12 to receive and mate with a complimentary connector component (not shown). The connector component 10 is used herein for purposes of illustration, and those skilled in the art will appreciate that the present invention may be employed with any one of a wide variety of connectors and connector components.

The illustrated electrical component 10 is a receptacle having a housing or shell 14, a plurality of inserts 15, 16, 17, 18 and 19, and a plurality of permanently mounted contacts, such as contact 20. Each contact has forward and rearward pins, 22 and 24 respectively, the rearward pin 24 adapted to electrically engage a contact, such as socket contact 26, which terminates an insulated conductor 28. Once again, the particular contact structures are merely illustrative, and other structures would be entirely apparent to those skilled in the art. For example, the contacts which terminate the conductors might extend completely through to the forward end 12 of the receptacle, thereby also serving as the mating contact which engages the complimentary connector component.

Although each of the inserts 15–18 provide useful functions, those are also well known and form no part of the present invention. Therefore, their structure and function will be omitted from this description. Insert 19, on the otherhand, is important to the present invention and its structure configuration and function are described in greater detail below.

The insert 19 comprises an elastomeric body having a plurality of longitudinally or axially extending pockets 30. The pockets 30 extend from the outside end 32 entirely through the insert 19 and align with pockets in insert 18. The pockets are also configured to receive and support a conductive member such as a contact terminated conductor 28, and each pocket includes one or more circumferential risers 34 which engage the conductor 28 to provide an environmental seal.

In accordance with the present invention the insert 19 includes an integrally molded membrane 36 adjacent its outside, conductive member-receiving end 32, the membrane 36 serving to completely seal each pocket 30 from the ambient environment. The membrane 36 is molded with the insert 19 and is, therefore, constructed from the same elastomeric material as is the insert 19. The particular material used may be selected from a wide variety of well known natural and synthetic rubbers or elastomers and will be selected for the specific resiliency, hardness, temperature sensitivity and chemical resistivity required for a given application.

The membrane 36 must have a thickness sufficent to maintain the integrity of the seal over its associated vacant pocket 30 during normal operation of the connector. On the other hand, the membrane 36 must not have a thickness too great to prevent proper installation of the contact terminated conductor 28. For example, where a fragile socket contact, such as contact 26, is to be assembled to the connector, the membrane 36 must not be so thick such that the required penetration force might bend or damage the contact. Of course, the thickness of the membrane 36 will depend on the particular elastomeric material from which the insert 19 is molded, as well as the dimensions of the pocket and conductive member.

By way of example, where a membrane is used with an insert molded from silicone rubber and having a pocket diameter of 0.100 inch, the membrane should have a thickness in the range of about 0.010 to 0.015 inch in order to properly seal the pockets while still easily accepting a size 20 socket contact.

Figure 4:
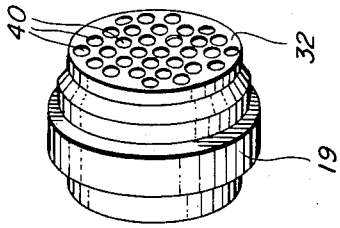
FIG. 4 is a perspective view of one form of elastomeric insert prior to assembly within a connector shell and clearly illustrating the outside surface of the insert.

The membrane 36 is molded in the insert at a longitudinal position within the pocket 30 offset slightly from the outside end 32. As can be seen clearly in FIG. 4, this arrangement results in the formation of a plurality of visible indexing recesses 40 which locate each of the pockets 30. Of course, the indexing recesses 40 facilitate assembly of the contact terminated conductors to the connector, since the assemblor can easily locate each pocket 30. In addition, since the membrane is adjacent the connector's outside end 32, any damage to the membrane at any of the pockets 30 will be easily discovered on inspection.

Figure 3:
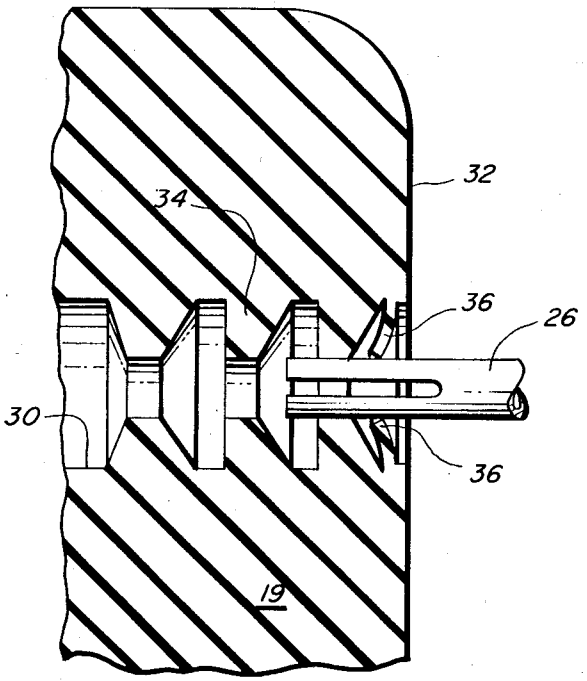
FIG. 3 is a view similar to that of FIG. 2 illustrating the manner in which the conductive member penetrates the sealing membrane.
Figure 2:
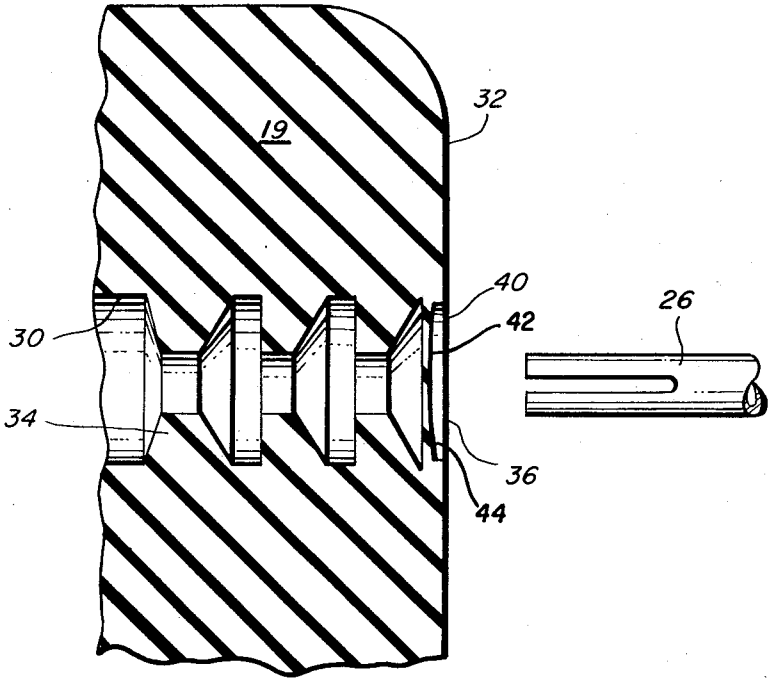
FIG. 2 is an enlarged, fragmentary cross-sectional view showing the elastomeric insert and membrane in greater detail and a lead portion of a conductive member immediately prior to assembly with the connector.

Of course, if the membrane, or portion of the membrane, is torn from the insert, these small fragments might interfere with the proper electrical engagement of the contacts within the connector. Therefore, it is preferable that the membrane 36 be positioned at a longitudinal position along the pocket 30 where the diameter of the pocket is greater than the diameter of the contacts used in the connector. When the membrane 36 is so positioned, it follows that the cross section of the membrane will be greater than the cross section or diameter of the contacts. This relationship is shown clearly in FIG. 2. Since the contact thereby acts against the membrane at the center rather than the periphery of each pocket, the membrane will remain integral with the insert body as clearly shown in FIG. 3. Thus, the likelihood that a contact will sever the membrane from the insert 19 during insertion and carry portion of the membrane into the connector is reduced.

In addition, the membrane may be molded with a relatively thin central portion 42 and a relatively thick portion 44 adjacent the periphery of each pocket. This arrangement creates a stress point in the membrane at the center of each pocket 30, thereby helping to further reduce the possibility of severing the membrane from the insert body.

It will be apparent to those skilled in the art that the present invention provides a remarkably simple and inexpensive solution to an otherwise vexing problem. The seal obtained by the membrane 36 is complete, and its reliability is far superior to prior art sealing techniques. In addition, the seal does not require any additional steps in assembling the connector to an electric cable. Finally, it is obvious that if a previously used pocket is no longer needed or if a membrane should fail in use, a conventional sealing plug may be used by simply inserting the plug into the pocket 30 past the previously broken or pierced membrane.

Of course, it should be understood that various changes and modifications to the preferred emodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. In a conductor receiving assembly having a conductor receiving end for receiving, containing and coupling the extremity of a given length of at least one of a plurality of different conductors of substantially circular cross-section and including a contact member to an element contained within said assembly, the minimum outside diameter and maximum outside diameter of any part of said given length of conductor not being less than a first diameter value and not in excess of a second larger diameter value respectively, a member for environmentally sealing said conductor receiving end prior to and following the insertion of a conductor through said conductor receiving end forwardly into said assembly, said member comprising:

an insert of elastic material such as an elastomer or the like affixed to said assembly and environmentally closing said conductor receiving end, said insert having at least one longitudinally extending pocket for forwardly receiving said given length of conductor;

said pocket extending from substantially the conductor receiving end of said conductor assembly forwardly through the insert for communicating with an element within said assembly remote from said conductor receiving end;

said pocket having at least one radially inwardly extending riser formed of said material defining a substantially circularly shaped constriction in said pocket, the diameter of said constriction being of a value less than said minimum diameter value by an amount which taken along with the elastic properties of said material will allow passage of said given length of conductor yet produce a gas seal between the outer surface of said conductor and the material defining said riser when said given length of said conductor is contained within said assembly;

said pocket having a substantially circular enlarged portion extending rearwardly from the rearward longitudinal extent of said riser to a given longitudinal position adjacent the conductor receiving end surface of said insert, the diameter of said enlarged portion at said given longitudinal position, being substantially larger than said second diameter value;

and a relatively thin membrane having a substantially uniform thickness over an area thereof equal to an area corresponding to said second diameter value affixed to said insert and sealingly closing said pocket at said given longitudinal position, said membrane being sufficiently thin to permit its puncturing when said conductor is inserted into said pocket, with the inner longitudinal displacement between the rearward longitudinal extent of said riser and said given longitudinal position of said membrane being such to define a space within said pocket sufficiently large to allow portions of said membrane, when punctured, to be contained therein and thereby prevented from being carried into portions of said pocket forward of the rearward longitudinal extent of said riser when said conductor is fully inserted into said assembly, said membrane being formed with a central section which is relatively thin compared to the surrounding membrane portions affixed to said insert so as to produce a central stress area tending to enforce puncturing of the membrane at its central portion without severing the membrane from the insert when punctured by said conductor.

2. An assembly according to claim 1 wherein said insert is made of a moldable elastomeric material and said insert and said membrane are integrally molded.

3. An assembly according to claim 1 wherein said given longitudinal position of said membrane is sufficiently displaced forwardly of the conductor receiving end surface of said insert to provide a visible indexing recess without preventing the mechanical integrity of the membrane from being visually ascertained.

* * * * *